US006662798B1

(12) United States Patent
Johnson

(10) Patent No.: US 6,662,798 B1
(45) Date of Patent: Dec. 16, 2003

(54) BOW AND HANDLE COMBINATION

(76) Inventor: Bradley W. Johnson, 109 Teakwood Ct., Techachapi, CA (US) 93561

( * ) Notice: Subject to any disclaimer, the term of this patent is extended or adjusted under 35 U.S.C. 154(b) by 0 days.

(21) Appl. No.: 10/280,815

(22) Filed: Oct. 28, 2002

(51) Int. Cl.[7] ..... F41B 5/00
(52) U.S. Cl. ..... 124/88
(58) Field of Search ..... 124/23.1, 86, 88; 16/422, 426, 427, 429, 430

(56) References Cited

U.S. PATENT DOCUMENTS 2,426,283 A * 8/1947 Pearson ..... 124/23.1
4,966,124 A 10/1990 Burlling
5,081,979 A * 1/1992 Burling ..... 124/23.1
5,241,945 A * 9/1993 Shepley, Jr. ..... 124/88
5,243,958 A * 9/1993 Shepley, Jr. ..... 124/88
5,469,834 A 11/1995 Higgins
5,615,663 A 4/1997 Simonds
5,842,460 A * 12/1998 Barber ..... 124/88

* cited by examiner

*Primary Examiner*—Kien T. Nguyen

(57) ABSTRACT

A bow and handle combination includes a bow having a handle section. A handle assembly is removably attachable to the handle section. The handle assembly includes a pair of backing such that the backing sections extend around the handle section. Each of backing sections has an outer side with a threaded opening extending therein. Each of a pair of first handles each has an inner surface and an outer surface. The inner surfaces are abutted against one of the outer sides. Each of the first handles has an opening therein which is alignable with the threaded openings. Each of a pair of brackets is positioned around the backing sections for securing the backing sections on the handle section. Each of a pair of threaded securing members is selectively extended through an aligned set of openings and the brackets.

9 Claims, 4 Drawing Sheets

BOW AND HANDLE COMBINATION

BACKGROUND OF THE INVENTION

1. Field of the Invention

The present invention relates to bow handles and more particularly pertains to a new bow handle for enabling an archer to adjust his bow so that it fits their hand better.

2. Description of the Prior Art

The use of bow handles is known in the prior art. U.S. Pat. No. 5,615,663 describes an archery bow grip with an improved adjustable grip comprising a thumb side plate and a finger side plate moveable with respect to each other. Another type of bow handle is U.S. Pat. No. 4,966,124 describes a grip assembly for an archery bow for being installed on the riser of a bow to provide a frictionless pivot connection between the bow and the grip and which does not impart torque to the bow. U.S. Pat. No. 5,469,834 describes an archery bow with tilting and translating grip that can move from side to side and tilt.

While these devices fulfill their respective, particular objectives and requirements, the need remains for a system that includes a grip that can be rotated and customized to fit a users hand and fingers.

SUMMARY OF THE INVENTION

The present invention meets the needs presented above by allowing the present invention to be rotated about a vertical axis of bow. The present invention can also be adjusted in width and gripping surface characteristics to accommodate any user.

Another object of the present invention is to provide a new bow handle that would enable an archer to adjust the grip on their bow so that it fits their hand more comfortably. This would align the bow correctly to make it easier for the archer to hold the bow steady and shoot accurately. This would be particularly useful for users that have strength or mobility problems with their wrist.

Still another object of the present invention is to provide a new bow handle that would offer a wide range of styles so that an archer could select a set that would fit their hand correctly.

To this end, the present invention generally comprises a bow and handle combination device including a bow having a handle section with a perimeter length less than a perimeter length of bow sections positioned on either side of the handle section. A handle assembly is removably attachable to the handle section. The handle assembly includes a pair of backing sections each with an inner side and an outer side. The inner sides have a slot positioned therein. The slots are positioned on either side of the handle section such that the backing sections extend around the handle section. Each of the outer sides has a threaded opening extending therein. Each of a pair of first handles each has an inner surface and an outer surface. The inner surfaces are abutted against one of the outer sides. Each of the first handles has an opening therein which is alignable with the threaded openings. Each of a pair of brackets is positioned around the backing sections for securing the backing sections on the handle section. Each of a pair of threaded securing members is selectively extended through an aligned set of openings and the brackets.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty, which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
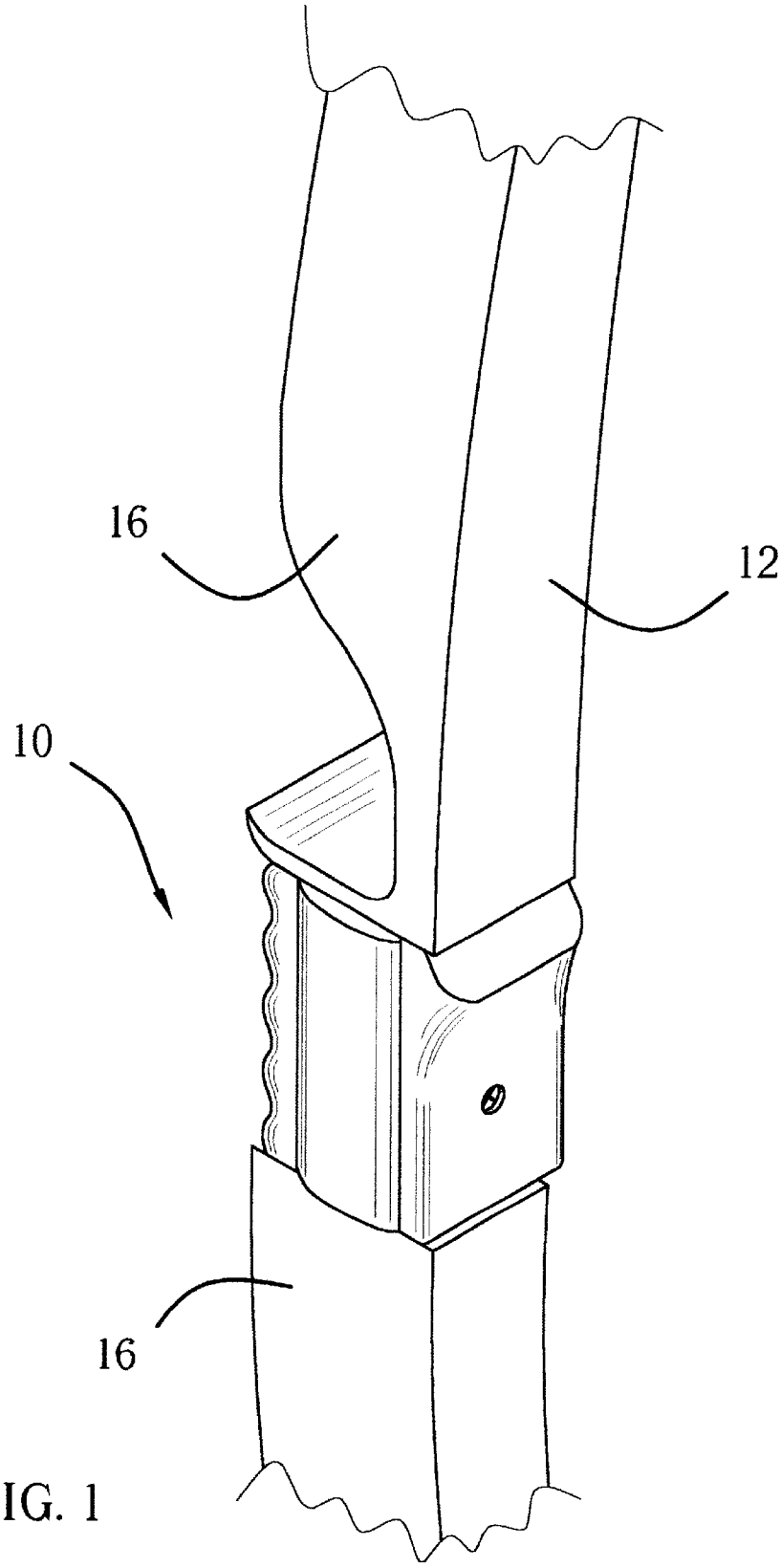
FIG. 1 is a perspective view of a bow and handle combination according to the present invention.
Figure 2:
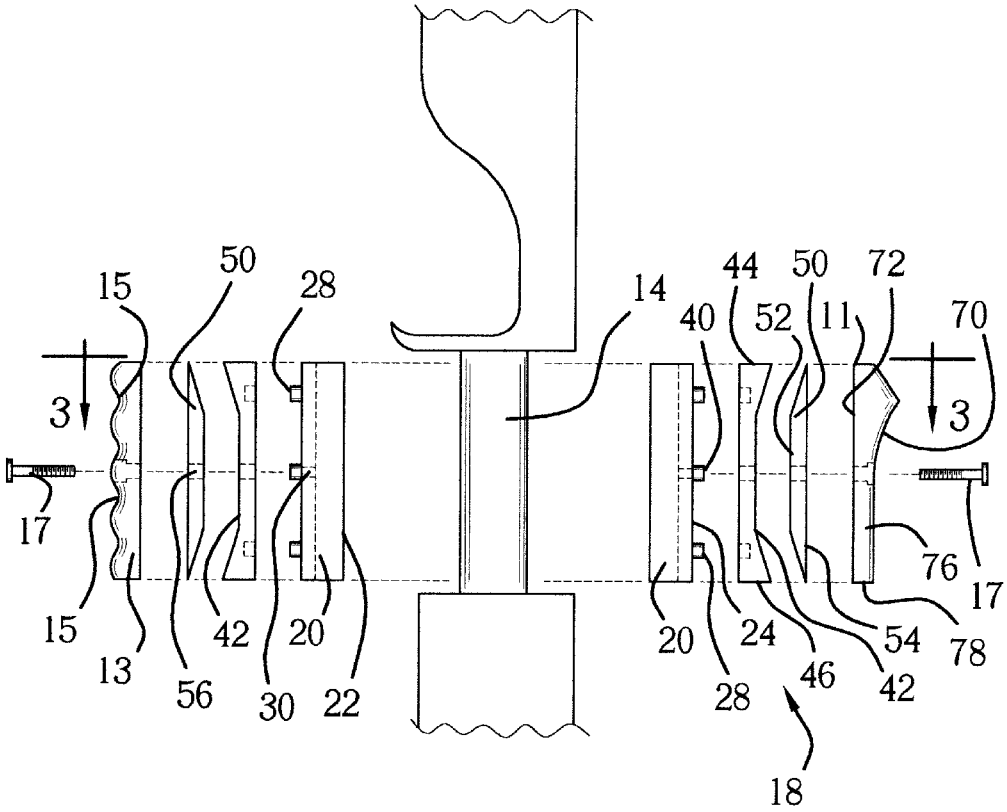
FIG. 2 is a side exploded view of the present invention.

With reference now to the drawings, and in particular to FIGS. 1 through 4 thereof, a new bow handle embodying the principles and concepts of the present invention and generally designated by the reference numeral 10 will be described.

As best illustrated in FIGS. 1 through 4, the bow and handle combination 10 generally comprises a conventional bow 12 with an improvement in handle construction. The bow 12 has a handle section 14 having a cylindrical shape and has a perimeter length less than a perimeter length of bow sections 16 positioned on either side of the handle section 14. This provides a base for positioning a handle assembly 18 thereon, which can be altered to the needs of the user of the bow.

The handle assembly 18 is removably attachable to the handle section 14 and may include a plurality of components such as a pair of backing sections 20 each having an inner side 22 and an outer side 24. Each of the inner sides 22 has a cylindrical slot 26 positioned therein such that the backing sections 20 comprise mating portions 21. Each is positioned on an opposite side of the handle section 14 and abutted there against such that the mating portions 21 extend around and cover the handle assembly 18. The outer sides 24 are planar. Preferably, a plurality of pegs 28 is attached to and extends away from the outer sides 24 of each of the backing sections 20. Each of the backing sections 20 has a centrally positioned one of the pegs 28 having an end has a threaded opening 30 extending therein. If the pegs 28 are not used, the threaded openings 30 may be extended into the backing section 20 themselves.

Each of a pair of first handles 32 each has an inner surface 34 and an outer surface 36. The inner surfaces 34 have a size and shaped adapted for abutting against and covering one of the outer sides 24. Each of the inner surfaces 34 has a plurality of depressions 38 therein positioned for receiving the nubs 40. Each of first handles 32 has an opening therein which is alignable with the threaded opening 30 in the nubs 40 when the first handles 32 are abutted against the backing sections 20. The outer surfaces 36 have a concave depression 42 therein extending from an upper end 44 to a lower end 46 of the outer surfaces 36 and extending through side edges 48 of the first handles 32. The first handles 32 may be used for gripping the bow 12 without additional components.

Each of a pair of spacing members 50 is positionable against the outer surfaces 36 of the first handles 32. The spacing members 50 have a first side 52 having a shape adapted for positioning in the concave depressions 42. Each of the spacing members 50 has a second side 54 having a generally planar configuration. The spacing members 50 having an opening 56 extending therethrough which is alignable with the openings 56 in the first handles 32.

Figure 3:
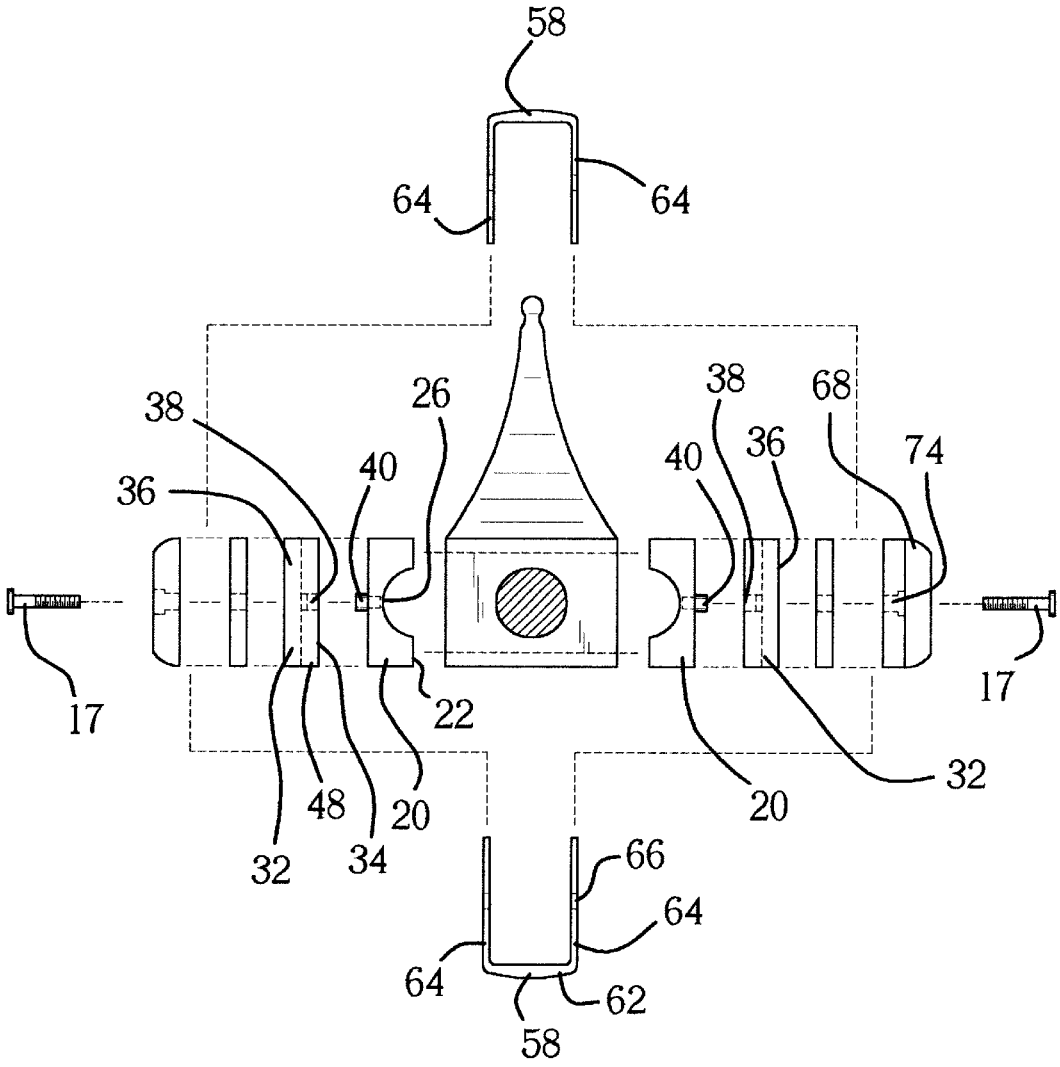
FIG. 3 is an exploded view taken along the line 3—3 of FIG. 2 of the present invention.
Figure 4:
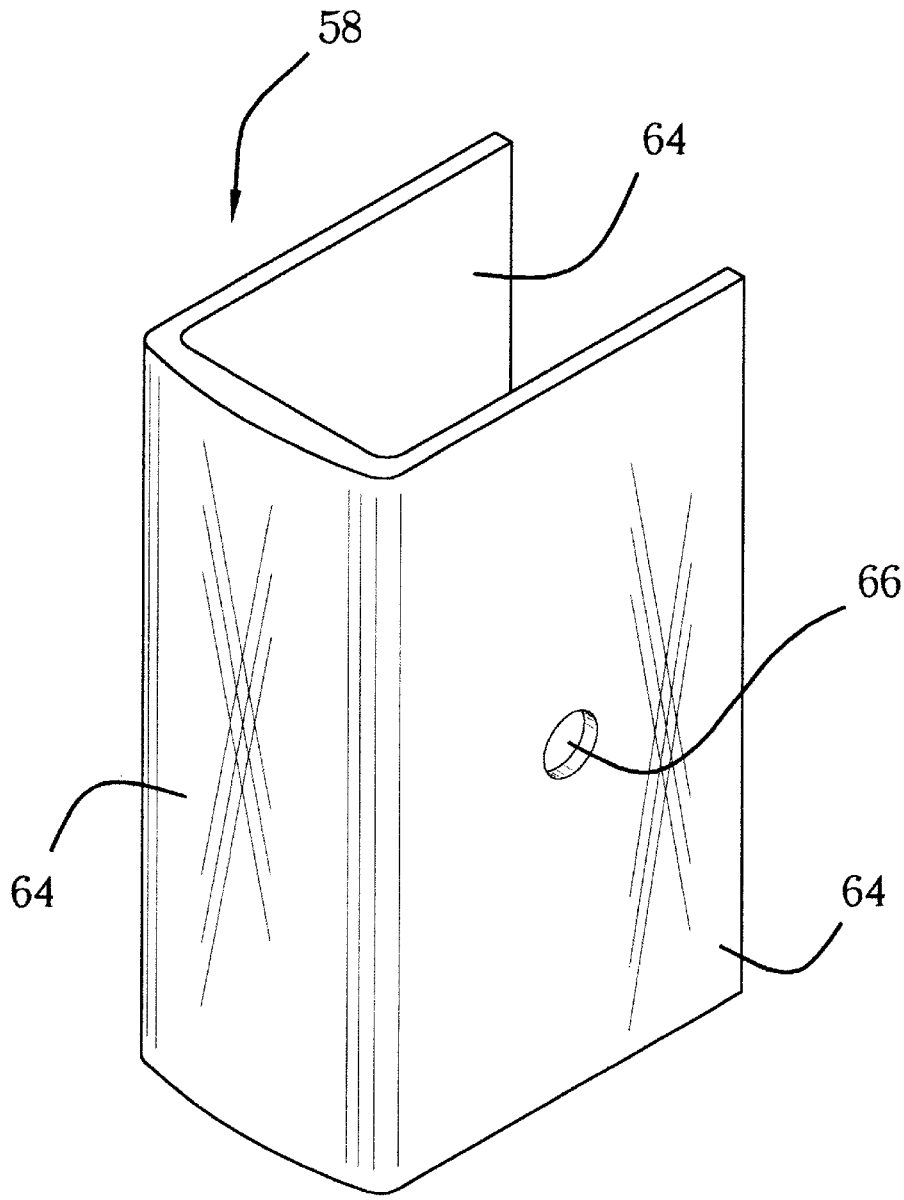
FIG. 4 is a perspective view of a bracket of the present invention.

Each of a pair of brackets 58 includes a U-shaped member 60 having a central section 62 and a pair of arms 64. The arms 64 are positioned over one of the second sides 54 of the spacing members 50 such that each of the central sections 62 are positioned adjacent to the side edges 48 and opposite of each other as shown in FIG. 3. Each of the arms 64 has a hole 66 extending therethrough and is alignable with the openings 56 in the spacing members 50. The central sections 62 comprise a resiliently stretchable material to secure the backing sections 20, first handles 32 and spacers 50 against each other.

Each of a pair of gripping members 68 has a gripping surface 70 and a mating surface 72. Each of the mating surfaces is generally planar and is positionable against one of the arms 64 of the brackets 58. The gripping members 68 have an opening 74 extending therethrough that is alignable with the holes 66 in the brackets 58. The gripping surface 70 of a first of the gripping members 76 is contoured from a bottom edge 78 to a top edge 11 such that the first gripping member 76 generally becomes wider from the bottom edge 78 to the top edge 11. The gripping surface 70 of a second of the gripping members 13 has a plurality of finger receiving indentations 15 therein.

Each of a pair of threaded securing members 17 is selectively extended through an aligned set of openings and holes and is threadably securable to one of the threaded openings 30.

In use, the backing sections 20 are positioned on the handle section 14 and the first handles 32 are then positioned on the backing sections 20. Additional components, such as spacing members 50 and gripping members 68 may be retrofitted as needed to provide a better hand fit for the user of the bow. The bracket is generally going to be positioned such that it encompasses the second to last component to hold inner positioned components to the handle section 14 while the outer positioned components, such as the gripping members 68, are secured with the threaded securing member 17. The spacing members 50 and gripping members 68 may have alternate thickness and designs depending on the user's needs.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A bow and handle combination device comprising:

a bow having a handle section having a perimeter length less than a perimeter length of bow sections positioned on either side of said handle section;

a handle assembly being removably attachable to said handle section, said handle assembly including;

a pair of backing sections each having an inner side and an outer side, each of said inner sides having a slot positioned therein, said slots being positioned on either side of said handle section such that said backing sections extend around said handle section, each of said outer sides having a threaded opening extending therein;

a pair of first handles each having an inner surface and an outer surface, each of said inner surfaces being abutted against one of said outer sides, each of said first handles having an opening therein which is alignable with said threaded openings;

a pair of brackets being positioned around said backing sections for securing said backing sections on said handle section; and a pair of threaded securing members, each of said securing members being selectively extended through an aligned set of openings and said brackets.

2. A bow and handle combination device comprising:

a bow having a handle section having a cylindrical shape and having a perimeter length less than a perimeter length of bow sections positioned on either side of said handle section;

a handle assembly being removably attachable to said handle section, said handle assembly including;

a pair of backing sections each having an inner side and an outer side, each of said inner sides having a cylindrical slot positioned therein such that said backing sections comprise mating portions wherein each is positioned on an opposite side of the handle section and abutted there against such that said mating portions extend around and cover said handle assembly, said outer sides being planar, each of said backing sections having a centrally positioned threaded opening extending therein;

a pair of first handles each having an inner surface and an outer surface, each of said inner surfaces having a size and shaped adapted for being abutted against and covering one of said outer sides, each of first handles having an opening therein which is alignable with said threaded openings when said first handles are abutted against said backing sections;

a pair of brackets being positioned around said backing sections for securing said backing sections on said handle section; and a pair of threaded securing members, each of said securing members being selectively extended through an aligned set of openings and said brackets and being threadably securable to one of said threaded openings.

3. The bow and handle combination device as in claim 2, wherein further including a plurality of pegs being attached to and extending away from said outer sides of each of said backing sections, each of said inner surfaces of said first handles having a plurality of depressions therein positioned for receiving said nubs.

4. The bow and handle combination device as in claim 2, wherein each of said outer surfaces having a concave depression therein extending from an upper end to a lower end of said outer surfaces and extending through side edges of said first handles.

5. The bow and handle combination device as in claim 2, wherein said handle assembly further includes a pair of spacing members, each of said spacing members being positionable against said outer surfaces of said first handles, each of said spacing members having an opening extending therethrough and being alignable with said opening in said first handles, a pair of gripping members, each of said gripping members having a gripping surface and a mating surface, each of said mating surfaces being generally planar and being positionable over one of said spacing members, wherein said securing members are extendable through openings in said spacing members and gripping member.

6. The bow and handle combination device as in claim 5, wherein said gripping surface of a first of said gripping members being contoured from a bottom edge to a top edge such that said first gripping member generally becomes wider from said bottom edge to said top edge, said gripping surface of a second of said gripping members having a plurality of finger receiving indentations therein.

7. The bow and handle combination device as in claim 5, wherein said brackets further include a U-shaped member having a central section and a pair of arms, each of said arms being positioned between one of said spacers and one of said gripping members such that each of said central sections are positioned adjacent to side edges of said first handle, each of said arms having a hole extending the therethrough and being alignable with said openings in said spacing members for receiving one of said securing members.

8. The bow and handle combination device as in claim 7, wherein each of said central sections comprises a resiliently stretchable material.

9. A bow and handle combination device comprising:

a bow having a handle section having a cylindrical shape and having a perimeter length less than a perimeter length of bow sections positioned on either side of said handle section;

a handle assembly being removably attachable to said handle section, said handle assembly including;

a pair of backing sections each having an inner side and an outer side, each of said inner sides having a cylindrical slot positioned therein such that said backing sections comprise mating portions wherein each is positioned on an opposite side of the handle section and abutted there against such that said mating portions extend around and cover said handle assembly, said outer sides being planar, a plurality of pegs being attached to and extending away from said outer sides of each of said backing sections, each of said backing sections having a centrally positioned one of said pegs having an end having a threaded opening extending therein;

a pair of first handles each having an inner surface and an outer surface, each of said inner surfaces having a size and shaped adapted for being abutted against and covering one of said outer sides, each of said inner surfaces having a plurality of depressions therein positioned for receiving said nubs, each of first handles having an opening therein which is alignable with said opening in said nubs when said first handles are abutted against said backing sections, each of said outer surfaces having a concave depression therein extending from an upper end to a lower end of said outer surfaces and extending through side edges of said first handles;

a pair of spacing members, each of said spacing members being positionable against said outer surfaces of said first handles, each of said spacing members having a first side having a shape adapted for positioning in said concave depressions, each of said spacing members having a second side having a generally planar configuration, each of said spacing members having an opening extending therethrough and being alignable with said opening in said first handles;

a pair of brackets, each of said brackets including a U-shaped member having a central section and a pair of arms, each of said arms being positioned over one of said second sides of said spacing members such that each of said central sections are positioned adjacent to said side edges and opposite of each other, each of said arms having a hole extending therethrough and being alignable with said openings in said spacing members, each of said central sections comprising a resiliently stretchable material;

a pair of gripping members, each of said gripping members having a gripping surface and a mating surface, each of said mating surfaces being generally planar and being positionable against one of said arms of said brackets, each of said gripping members having an opening extending therethrough and being alignable with said holes in said brackets, said gripping surface of a first of said gripping members being contoured from a bottom edge to a top edge such that said first gripping member generally becomes wider from said bottom edge to said top edge, said gripping surface of a second of said gripping members having a plurality of finger receiving indentations therein; and a pair of threaded securing members, each of said securing members being selectively extended through an aligned set of openings and holes and being threadably securable to one of said threaded openings.

* * * * *